US009156278B2

(12) United States Patent
Boland et al.

(10) Patent No.: US 9,156,278 B2
(45) Date of Patent: Oct. 13, 2015

(54) QUALITY ANALYSIS OF PRINTHEADS WITH CLEAR FLUID

(71) Applicants: Stuart J. Boland, Denver, CO (US); Sean K. Fitzsimons, Thornton, CO (US); Scott R. Johnson, Erie, CO (US); William Edward Manchester, Erie, CO (US); Casey E. Walker, Boulder, CO (US)

(72) Inventors: Stuart J. Boland, Denver, CO (US); Sean K. Fitzsimons, Thornton, CO (US); Scott R. Johnson, Erie, CO (US); William Edward Manchester, Erie, CO (US); Casey E. Walker, Boulder, CO (US)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/920,572

(22) Filed: Jun. 18, 2013

(65) Prior Publication Data

US 2014/0368571 A1 Dec. 18, 2014

(51) Int. Cl.
*B41J 29/393* (2006.01)
*B41J 2/21* (2006.01)

(52) U.S. Cl.
CPC ..... *B41J 2/2132* (2013.01); *B41J 2/211* (2013.01); *B41J 2/2114* (2013.01); *B41J 2/2142* (2013.01)

(58) Field of Classification Search
USPC ..... 347/5, 6, 14, 19, 20, 21, 23, 98
See application file for complete search history.

(56) References Cited

U.S. PATENT DOCUMENTS

| | | | | |
|---|---|---|---|---|
| 5,627,571 | A * | 5/1997 | Anderson et al. | 347/19 |
| 6,050,680 | A | 4/2000 | Moriyama et al. | |
| 6,097,406 | A | 8/2000 | Lubinsky et al. | |
| 6,378,976 | B1 * | 4/2002 | Byers et al. | 347/19 |
| 6,550,892 | B1 | 4/2003 | Sharma | |
| 6,893,107 | B2 * | 5/2005 | Kramer | 347/19 |
| 7,318,637 | B2 * | 1/2008 | Ishimoto et al. | 347/19 |
| 7,959,252 | B2 * | 6/2011 | Endo | 347/19 |
| 8,262,215 | B2 | 9/2012 | Izuo | |
| 2005/0073548 | A1 * | 4/2005 | Suzuki | 347/23 |
| 2008/0150980 | A1 * | 6/2008 | Endo | 347/9 |
| 2009/0033703 | A1 * | 2/2009 | Lee | 347/14 |
| 2009/0201548 | A1 | 8/2009 | Hirakawa | |
| 2009/0244120 | A1 * | 10/2009 | Yamazaki | 347/6 |
| 2010/0039463 | A1 * | 2/2010 | Van Thillo et al. | 347/9 |
| 2010/0301600 | A1 | 12/2010 | Goto et al. | |
| 2011/0019245 | A1 * | 1/2011 | Adachi | 358/448 |
| 2011/0148975 | A1 | 6/2011 | Izuo | |
| 2011/0304862 | A1 | 12/2011 | Itoh et al. | |
| 2012/0140005 | A1 | 6/2012 | De Voeght et al. | |
| 2012/0194588 | A1 | 8/2012 | Kasai | |
| 2013/0293612 | A1 * | 11/2013 | Smith | 347/14 |

* cited by examiner

*Primary Examiner* — Julian Huffman
*Assistant Examiner* — Sharon A Polk
(74) *Attorney, Agent, or Firm* — Duft Bornsen & Fettig LLP

(57) ABSTRACT

Systems and methods for improving the quality analysis of printheads that apply transparent or hard-to-detect fluids to a media. The system includes a printhead operable to apply a clear fluid to a print media. The system also includes a controller operable to enter a diagnostic mode for quality analysis of the printhead. The controller initiates a supply of diagnostic fluid to the printhead that includes a colorant. The controller then directs the printhead to apply the diagnostic fluid to the print media. Because the diagnostic fluid includes a colorant, the output of the printhead will be more visible on the media.

20 Claims, 5 Drawing Sheets

QUALITY ANALYSIS OF PRINTHEADS WITH CLEAR FLUID

FIELD OF THE INVENTION

The invention relates to the field of printing systems.

BACKGROUND

Businesses or other entities having a need for volume printing typically purchase a production printer. A production printer is a high-speed printer used for volume printing (e.g., one hundred pages per minute or more). Production printers are typically continuous-form printers that print on webs of print media that are stored on large rolls.

A production printer typically includes a localized print controller that controls the overall operation of the printing system, and a marking engine (sometimes referred to as an "imaging engine" or as a "print engine"). The marking engine includes one or more printhead assemblies, with each assembly including a printhead controller and a printhead (or array of printheads). An individual printhead includes multiple tiny nozzles (e.g., 360 nozzles per printhead depending on resolution) that are operable to discharge ink as controlled by the printhead controller. A printhead array is formed from multiple printheads that are spaced in series across the width of the print media.

When in operation, the web of print media is quickly passed underneath the printhead arrays while the nozzles of the printheads discharge ink at intervals to form pixels on the web. In order to ensure optimal print quality, a print quality chart can be printed in a pattern that exposes any print irregularities caused by clogged nozzles or misalignment. In cyan, magenta, yellow, and black (CMYK) printing systems, a cyan, magenta or black nozzle defect will be apparent on a printed diagnostic chart since their output contrasts with the paper medium. However, it is difficult to detect problems in nozzles that apply yellow or clear fluids to a medium.

SUMMARY

Embodiments described herein provide for improved quality analysis of printheads that apply clear fluid. The system selectively supplies colorant to a printhead while undergoing a diagnostic mode operation for the printhead so that visibility of the printed output is temporarily improved. In this way, the system increases accuracy and efficiency of detecting defects, jet-outs or misdirects that occur in printhead nozzles that print hard-to-detect fluids.

One embodiment is a system that includes a printhead operable to apply a clear fluid to a print media. The system also includes a controller operable to enter a diagnostic mode for quality analysis of the printhead. The controller initiates a supply of diagnostic fluid to the printhead that includes a colorant, and directs the printhead to apply the diagnostic fluid to the print media.

Another embodiment is a method for diagnosing a printhead that applies clear fluid under normal operation. The method includes entering a diagnostic mode for quality analysis of the printhead that applies clear fluid to a print media and supplying a diagnostic fluid to the printhead that includes a colorant. The method further includes directing the printhead to apply the diagnostic fluid to the print media.

Another embodiment is a non-transitory computer readable medium embodying programmed instructions which, when executed by a processor, are able to perform a method. The method includes entering a diagnostic mode for quality analysis of the printhead that applies clear fluid to a print media and supplying a diagnostic fluid to the printhead that includes a colorant. The method further includes directing the printhead to apply the diagnostic fluid to the print media.

Other exemplary embodiments (e.g., methods and computer-readable media relating to the foregoing embodiments) may be described below.

DESCRIPTION OF THE DRAWINGS

Some embodiments of the present invention are now described, by way of example only, and with reference to the accompanying drawings. The same reference number represents the same element or the same type of element on all drawings.

DETAILED DESCRIPTION

The figures and the following description illustrate specific exemplary embodiments of the invention. It will thus be appreciated that those skilled in the art will be able to devise various arrangements that, although not explicitly described or shown herein, embody the principles of the invention and are included within the scope of the invention. Furthermore, any examples described herein are intended to aid in understanding the principles of the invention, and are to be construed as being without limitation to such specifically recited examples and conditions. As a result, the invention is not limited to the specific embodiments or examples described below, but by the claims and their equivalents.

Figure 1:
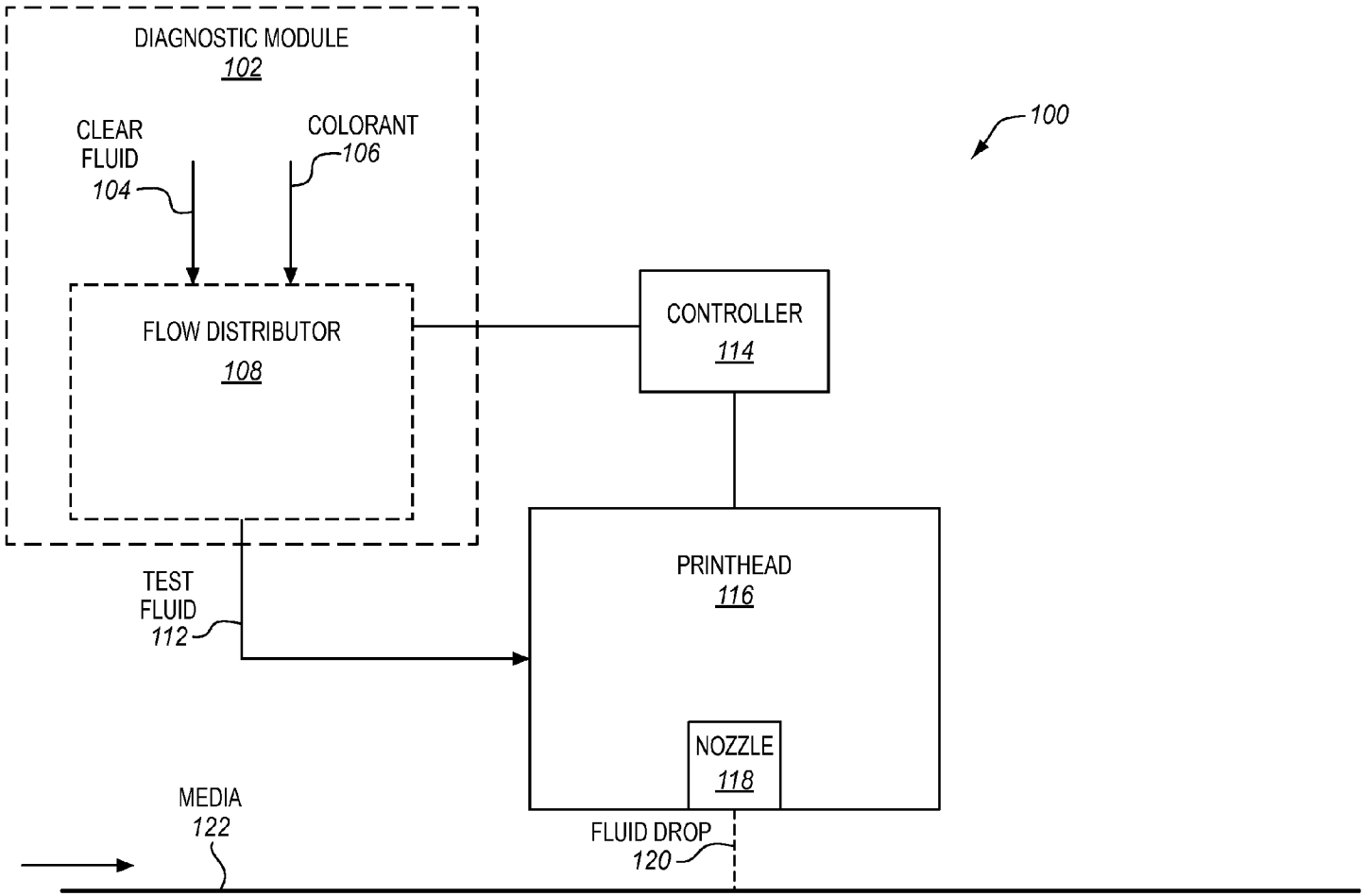
FIG. 1 is a block diagram of a printing system in an exemplary embodiment.

FIG. 1 is a block diagram of a printing system 100 in an exemplary embodiment. Printing system 100 comprises any system, device, or component operable to receive a print job and generate a marked physical output for the print job. Printing system 100 may comprise, for example, a continuous-form inkjet printing system or a drop-on-demand (DOD) printing system.

During the printing process, media 122 traverses a path through the printing system 100 in the direction indicated by the arrow in FIG. 1. Media 122 passes underneath a printhead 116 that includes at least one nozzle 118 that ejects a fluid drop 120 toward media 122. Media 122, now wet with the fluid (e.g., clear fluid 104, colorant 106, or both), continues along the path downstream of printing system 100 where a number of post-processing activities may occur.

In many printing systems, ink inside a nozzle/printhead can dry during times of inactivity, sometimes resulting in clogged nozzles. Image quality issues can arise when clogged nozzles attempt to resume ejecting drops of fluid since the flow of the ink from nozzle to media is disturbed. To locate nozzles that are not operating properly, a print quality chart may be printed so that the output of the nozzles may be compared to a known pattern. Defects are easily detectable in nozzles that print solid dark inks because the printed dark color output contrasts with the paper medium, which is typically white or light colored. However, some nozzles may print in light colors (e.g., yellow) or even a transparent fluid (e.g., overcoat composition), making it difficult to determine whether or not the nozzles are printing properly.

In one embodiment, printing system 100 has been enhanced to provide a temporary increase in the visibility of the printed output of printhead 116/nozzle 118. Printing system 100 includes a controller 114 which comprises any system, device, or component operable to control the visibility of the output of a printhead having hard-to-detect fluid. The increased visibility allows for easier detection of printheads that have jetting issues, such as when unwanted blank space is left on the media due to a partially or fully inoperative nozzle. Controller 114 may identify a printhead assembly (not shown), printhead 116, and/or nozzle 118 that, when under normal printer operation, applies a substantially clear or hard-to-detect fluid (e.g., clear fluid 104) to media 122. Then, when the printer system 100 enters a test/diagnostic mode, controller 114 directs a diagnostic module 102 to deliver a diagnostic fluid to printhead 116. The diagnostic fluid includes a colorant that improves the visibility of the output of printhead 116 on media 122.

Diagnostic module 102 includes a flow distributor 108 connected to a supply tank (not shown) that stores clear fluid 104 and a supply tank that stores colorant 106. Controller 114 is in communication with flow distributor 108 to regulate the supply of the fluids to printhead 116 during a diagnostic process. In this way, controller 114 may cause selective delivery of different fluids. For example, flow distributor 108 may deliver a clear fluid 104, a colorant 106, or a mixture of the clear fluid 104 and the colorant 106 to printhead 116 depending on the communication received from the controller 114. The fluid that is delivered to printhead 116 (e.g., diagnostic fluid 112) may depend on whether controller 114 is in a particular mode (e.g., a diagnostic mode). Controller 114 may be implemented, for example, as custom circuitry, as a special or general purpose processor executing programmed instructions stored in an associated program memory, or some combination thereof. The flow control device may comprise a valve, pump, filter, switch, vacuum, reservoir, or a combination of the above components capable of regulating the flow of a fluid or combination of fluids.

Clear fluid 104 may comprise a substantially transparent fluid, an overcoat composition, a pre-coat composition, yellow ink, white ink, or even colored inks that create little or no contrast with the medium to which the colored ink is applied. Colorant 106 may include black ink, cyan ink, magenta ink, a fluorescent colorant, etc.

Figure 2:
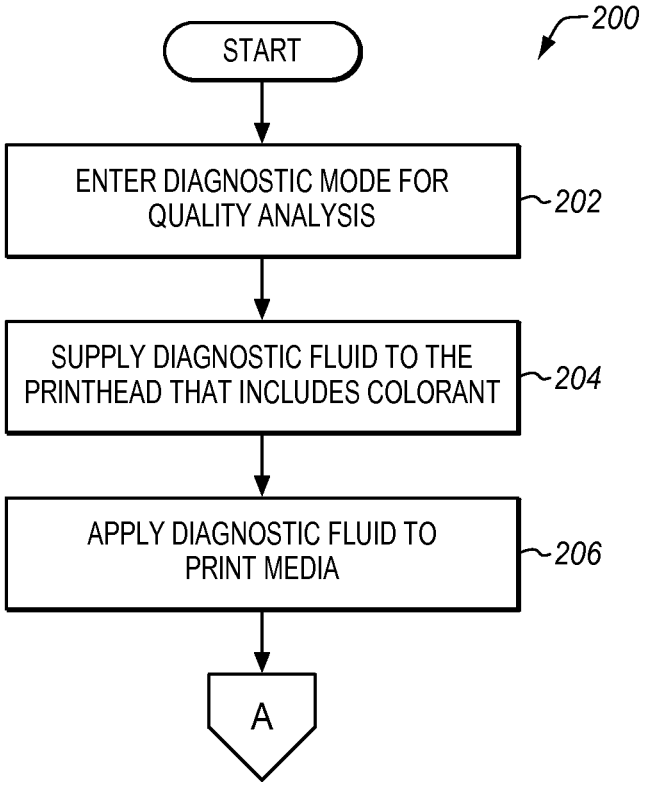
FIG. 2 is a flowchart illustrating a method for improving quality analysis of a printhead with clear fluid.

Illustrative details of the operation of printing system 100 will be discussed with regard to FIG. 2. FIG. 2 is a flowchart illustrating a method 200 for improving quality analysis of printheads with clear fluid in an exemplary embodiment. The steps of method 200 are described with reference to printing system 100 of FIG. 1, but those skilled in the art will appreciate that method 200 may be performed in other systems. The steps of the flowcharts described herein are not all inclusive and may include other steps not shown. The steps described herein may also be performed in an alternative order.

Assume for the present embodiment that printing system 100 applies clear fluid 104 to media 122 when under normal printer operation. In one embodiment, controller 114 is operable to receive and/or store information regarding the printhead assemblies (and a particular printhead 116, and/or nozzles 118) that apply transparent or difficult-to-detect fluids, which are referred to as clear fluids. A reservoir that supplies clear fluid 104 to printhead 116 may be referred to as the normal fluid supply for that printhead. As will be readily appreciated, the embodiment is not limited to improving the visual output of only a clear fluid applied from printhead 116, but rather, may be implemented for any fluid that is difficult to discern when printed on media 122. Thus, controller 114 may store configuration data received from a user operator or an analysis system that defines or redefines the fluids and/or printhead 116 that require improved output.

In step 202, controller 114 enters a diagnostic mode for quality analysis of printhead 116 that applies the clear fluid. The diagnostic mode includes a sequence of steps that temporarily improves the visibility of the output of one or more nozzles 118 of the printing system 100. In one embodiment, controller 114 enters the diagnostic mode automatically upon receiving a print job for a print quality chart. The print quality chart may also be referred to as a "test chart" or a "diagnostic chart."

In one embodiment, a print quality chart is selected by an operator of the printing system 100. A print job for a print quality chart comprises data that directs printhead 116 and/or nozzles 118 to eject fluid in a particular pattern onto media 122. The pattern may be generated by a host system, controller 114, or some other system based on a print quality analysis algorithm. Alternatively, the pattern may be a predetermined/pre-stored pattern that is retrieved from a memory location in a host system or controller 114. The print job may comprise one or more logical pages of print data for printing and controller 114 may receive the print job via a network interface, a serial communication interface, etc.

Controller 114 may process data within each received print job to determine whether the print job is for a print quality chart. If controller 114 identifies the print job as a print quality chart, then controller 114 enters the diagnostic mode. If controller 114 does not identify the print job as a print quality chart, then controller 114 proceeds under normal printer operation and applies clear fluid 104 in the normal fluid supply to printhead 116.

In another embodiment, controller 114 enters the diagnostic mode automatically upon receiving a print job for a print quality chart and determining that the print job requires application of a clear fluid. Thus, if controller 114 determines that a print job for a print quality chart is received but that the particular print quality chart does not require application of a clear fluid, then controller 114 resumes normal print operation without entering a diagnostic mode. However, if a print quality chart is received that requires application of a clear fluid, then controller 114 enters the diagnostic mode.

In yet another embodiment, controller 114 enters the diagnostic mode in response to a manual operator override. In this way, a user of printing system 100 controls activation of the diagnostic mode regardless of whether a print quality chart has been selected for printing.

Although the diagnostic mode in this embodiment is primarily discussed in the context of testing the output of a single printhead that applies a clear fluid, the method of FIG. 2 is not so limited. A diagnostic mode may be entered to test the proper operation of one or more printhead assemblies, one or more printheads 116 within a printhead assembly, or one or more nozzles 118 within a printhead 116. Furthermore, as discussed above, a diagnostic mode may be entered to improve the visibility of any fluid that is difficult to discern on media 122.

In step 204, controller 114 initiates a supply of diagnostic fluid 112 to printhead 116. The diagnostic fluid 112 comprises at least an amount of colorant. In one embodiment, the diagnostic fluid 112 is comprised only of colorant 106. In another embodiment, the diagnostic fluid 112 is comprised of a mixture of colorant 106 and clear fluid 104. Controller 114 may be operable to create the diagnostic fluid 112 by causing colorant 106 to replace the clear fluid 104 and to cause delivery the diagnostic fluid 112 to printhead 116 so that visibility of the printed output is improved.

In one embodiment, controller 114 is in communication with flow distributor 108 (e.g., a valve) that performs an injection of colorant 106 to printhead 116. Flow distributor 108 may be configured to connect multiple fluid supply reservoirs to printhead 116 and nozzle 118. In one embodiment, flow distributor 108 mixes the clear fluid 104 with colorant 106 and delivers the diagnostic fluid 112 to printhead 116. The fluids may be mixed in flow distributor 108 and then delivered to printhead 116, or delivered separately so that the mixing occurs within printhead 116. In another embodiment, flow distributor 108 may inhibit the clear fluid 104 from reaching printhead 116 and causes only colorant 106 to be delivered to printhead 116.

In step 206, controller 114 directs printhead 116 to apply the diagnostic fluid 112 to media 122. Once printed, media 122 may be inspected for print quality analysis. Print quality analysis may be performed by an analysis system or visually inspected by a human user. In either case, the colorant 106 that is added to or substituted in place of clear fluid 104 increases the accuracy and efficiency of diagnosing problems area in printing system 100. Print quality analysis may be performed for an overall determination of printhead health or an identification of a defective nozzle in a printhead 116 that normally applies a hard-to-detect fluid such as a pre-coat or overcoat composition.

Figure 3:
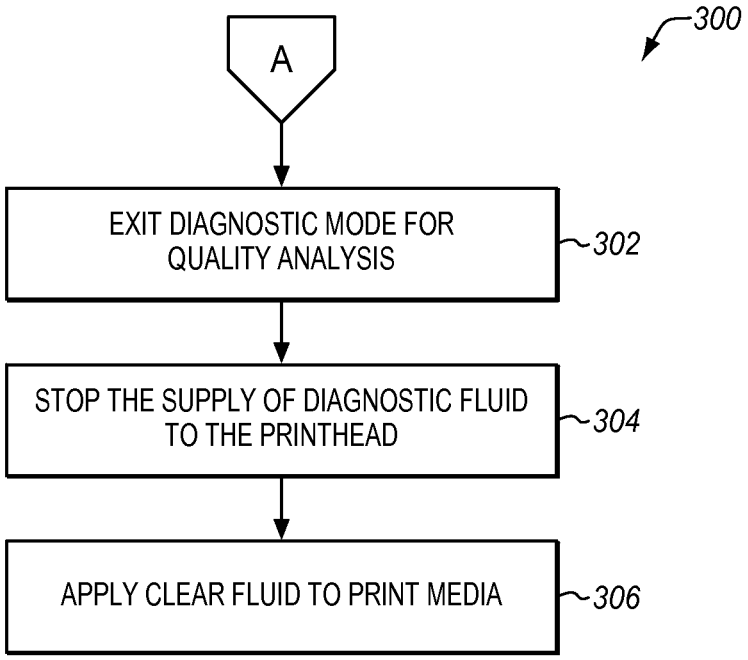
FIG. 3 is a flowchart illustrating a method for resuming normal printer operation.

FIG. 3 is a flowchart illustrating a method for resuming normal printer operation in an exemplary embodiment. The steps of method 300 are described with reference to printing system 100 of FIG. 1, but those skilled in the art will appreciate that method 300 may be performed in other systems. The steps of the flowcharts described herein are not all inclusive and may include other steps not shown. The steps described herein may also be performed in an alternative order.

At step 302, controller 114 exits the diagnostic mode for quality analysis. At step 304, controller 114 directs printing system 100 to stop the supply of diagnostic fluid 112 to printhead 116. In one embodiment, controller 114 directs the printhead 116 to switch to the normal fluid supply (e.g., clear fluid 104) for that printhead 116. In another embodiment, controller 114 directs flow distributor 108 to completely inhibit colorant 106 from reaching printhead 116 and causes only the fluid from the normal fluid supply (e.g., clear fluid 104) to be delivered to printhead 116. Controller 114 may further direct the flow distributor 108 to remove all colorant 106 from printhead 116 and nozzles 118. In one embodiment, controller 114 directs flow distributor 108 to suction and/or vacuum colorant 106 or diagnostic fluid 112 out of printhead 116 and nozzle 118. In another embodiment, controller 114 directs printhead 116 to continue printing fluid until all colorant 106 or diagnostic fluid 112 is cleared from printhead 116 and nozzle 118. In another embodiment, controller 114 may direct printer system 100 to vacuum and/or suction colorant 106 or diagnostic fluid 112 out of printhead 116 and nozzle 118 via a printhead cap or other method that can apply suction/vacuum to printhead 116 and nozzle 118. At step 306, normal printer operation is resumed and print controller 114 directs clear fluid 104 to flow into the printhead 116 which applies the clear fluid 104 to the media 122.

EXAMPLE

Figure 4:
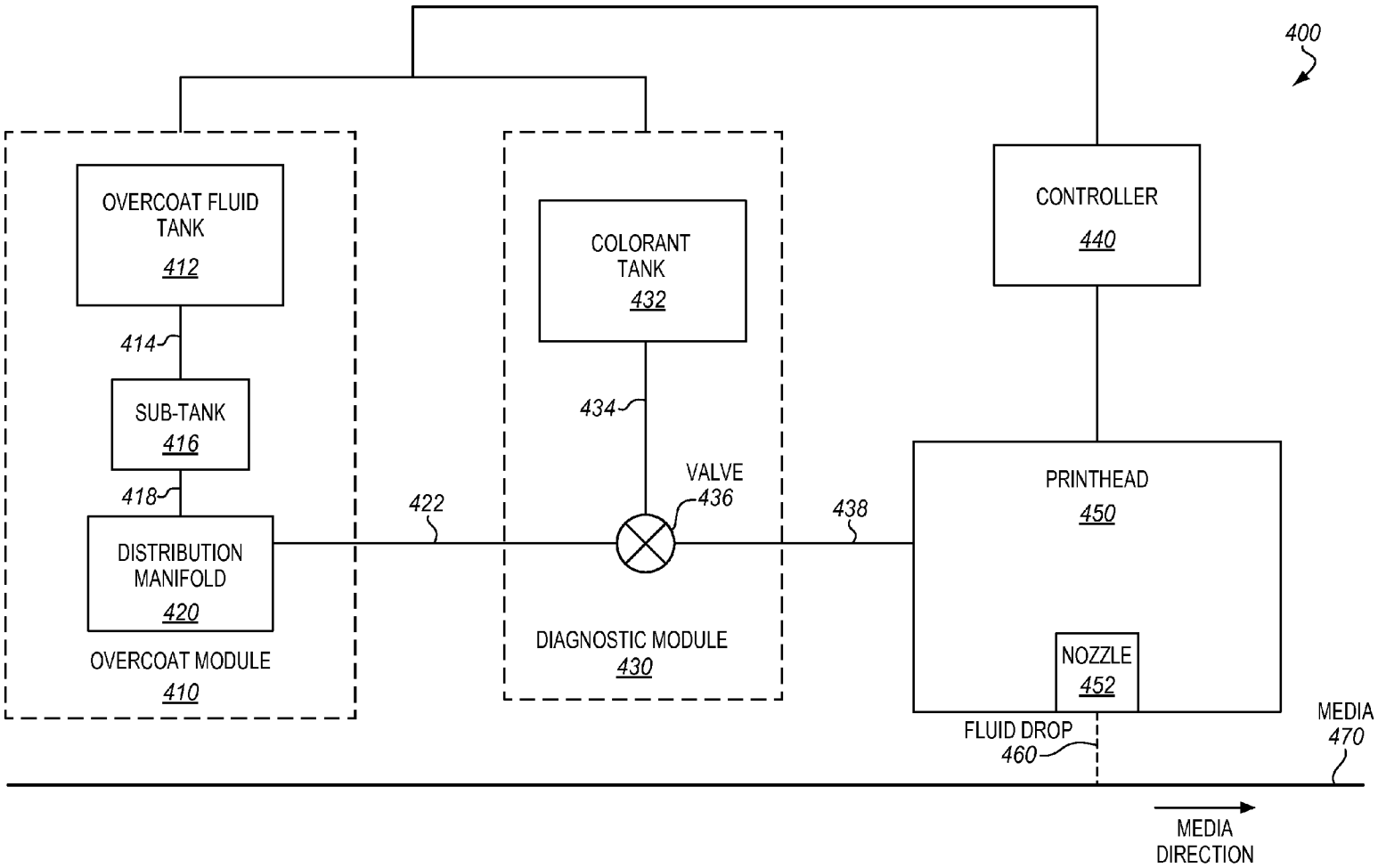
FIG. 4 is an exemplary block diagram of a printing system.

FIG. 4 is a block diagram of a printing system 400 in an exemplary embodiment. Printing system 400 includes an overcoat module 410, a diagnostic module 430, a printhead 450, and a controller 440. Overcoat module 410 includes an overcoat fluid tank 412 which supplies overcoat fluid through a main supply line 414 to one or more intermediate sub-tanks 416. A sensor in sub-tank 416 may be configured to determine when fluid supply is low and sends a signal to controller 440 to activate a pump or other method to transfer ink from overcoat fluid tank 412 to sub-tank 416. Overcoat fluid tank 412 may be replaced on-line during printing while sub-tank 416 provides fluid for printing onto media 470. Sub-tank 416 provides overcoat fluid to one or more distribution manifold(s) 420 through supply line 418. Distribution manifold 420 supplies the overcoat fluid to printhead 450 via a plurality of outlets to corresponding ink supply passages formed on printhead 450. It will be appreciated that the functionality of the overcoat module 410 is not limited to overcoat compositions but may also be operable for a pre-coat compositions or even regular inks that are hard to visually inspect when printed out, such as a yellow ink.

Printing system 400 also includes a diagnostic module 430 which comprises one or more colorant tank(s) 432 and valve(s) 436. In one embodiment, valve 436 is positioned between distribution manifold 420 and printhead 450. Valve 436 is configured to receive overcoat fluid from distribution manifold 420 via a supply line 422. Valve 436 is further configured to receive colorant from colorant tank 432 via a colorant supply line 434. Valve 436 is also configured to receive direction from controller 440 and output a range of different ratios of fluid (i.e., a ratio of overcoat/colorant) to printhead 450 via a printhead supply line 438.

When in normal operation, valve 436 is positioned by controller 440 so that only overcoat fluid is delivered to printhead 450. Valve 436 is either disconnected to colorant tank 432 or is positioned so as not allow colorant to flow through valve 436 (and subsequently the printhead supply line 438 and printhead 450) so long as controller 440 is under normal print operation.

In response to a user selecting to print a print quality chart, controller 440 enters a diagnostic mode and no longer operates in normal print operation. At the appropriate time in a diagnostic process, controller 440 directs valve 436 to allow colorant to flow through valve 436. In one embodiment, valve 436 connects to colorant supply line 434 and/or re-positions so that colorant flows into the printhead supply line 438. In another embodiment, controller 440 directs a pump to selectively inject amounts of colorant into the printhead supply line 438 (and subsequently printhead 450 and nozzle 452).

While in the diagnostic mode, controller 440 may direct valve 436 to continue, stop, or partially stop the flow of overcoat fluid to the printhead supply line 438 depending on the desired overcoat-to-colorant ratio to be outputted onto media 470. A fluid with at least some colorant present in the fluid may be referred to as a diagnostic fluid. In one embodiment, input received from an operator or a quality analysis system may cause valve 436 to decrease the overcoat-to-colorant ratio upon determination that the fluid output is still too difficult to detect. During diagnostic mode, valve 436 is configured to create and/or direct the diagnostic fluid to the printhead 450 so that the printhead 450 can apply the diagnostic fluid to the media 470. Valve 436 may remain configured to allow colorant to flow to the printhead 450 until the diagnostic mode is ended and normal print operation is resumed.

When the diagnostic mode ends, valve 436 stops the flow of colorant into the printhead supply line 438. The diagnostic fluid that is contained in printhead supply line 438, printhead 450, and nozzle 452 is removed. In one embodiment, overcoat fluid is flushed through printhead supply line 438, printhead 450, and nozzle 452 to a downstream waste location until no colorant is left. Valve 436 may be strategically placed in close proximity to printhead 450 so that waste and system response time is minimized. Controller 440 then resumes normal print operation, allowing the overcoat fluid to reach printhead 450. In an embodiment where printer system 400 includes a drop-on-demand (DOD) printer system, the colorant removal process is coupled with a cleaning and flushing process to ensure that the colorant is removed at the nozzle(s) 452 when the diagnostic mode is exited.

In one embodiment, printing system 400 includes an overcoat and/or pre-coat system. A pre-coat may be applied to enhance color, improve paper to ink interaction, or smooth the surface of a medium. An overcoat may be used to protect the ink image or add sheen. The pre-coat or overcoat may be applied only to areas where color ink is to be applied. Alternatively, the pre-coat or overcoat can be applied to a more general printing area.

Controller 440 may also be in communication with an analysis system (not shown). The analysis system comprises any system, component, or device operable to verify that print jobs have been printed correctly. The analysis system may be a distinct and separate automated off-line process or included in the printing system 400. In one embodiment, the analysis system compares printed pages against target images received from controller 440. For example, the analysis system may include a camera or scanner that captures images of printed pages, and a processor capable of matching captured images to target images stored in memory. In one embodiment, the analysis system is configured to determine if there are any discrepancies between a captured image and a target image. In another embodiment, the analysis system is configured to inspect a print out, and determine the overall health of one or more printhead 450 and/or nozzles 452. In another embodiment, the analysis system is configured to use the image data to preform calibration procedures on the printer system or printhead, such as alignment, color matching, or uniformity.

Figure 5:
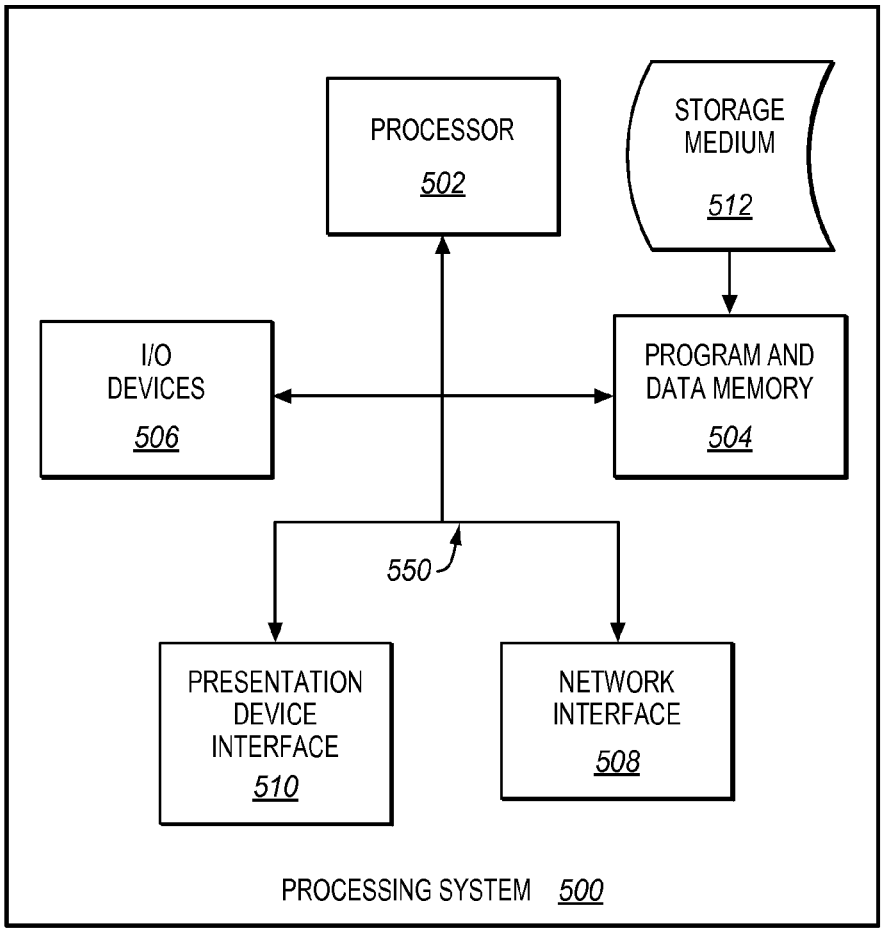
FIG. 5 is block diagram of a processing system operable to execute a computer readable medium embodying programmed instructions to perform desired functions in an exemplary embodiment.

Embodiments disclosed herein can take the form of software, hardware, firmware, or various combinations thereof. In one particular embodiment, software is used to direct a processing system of printing system 100 to perform the various operations disclosed herein. FIG. 5 illustrates a processing system 500 operable to execute a computer readable medium embodying programmed instructions to perform desired functions in an exemplary embodiment. Processing system 500 is operable to perform the above operations by executing programmed instructions tangibly embodied on computer readable storage medium 512. In this regard, embodiments of the invention can take the form of a computer program accessible via computer-readable medium 512 providing program code for use by a computer or any other instruction execution system. For the purposes of this description, computer readable storage medium 512 can be anything that can contain or store the program for use by the computer.

Computer readable storage medium 512 can be an electronic, magnetic, optical, electromagnetic, infrared, or semiconductor device. Examples of computer readable storage medium 512 include a solid state memory, a magnetic tape, a removable computer diskette, a random access memory (RAM), a read-only memory (ROM), a rigid magnetic disk, and an optical disk. Current examples of optical disks include compact disk-read only memory (CD-ROM), compact disk-read/write (CD-R/W), and DVD.

Processing system 500, being suitable for storing and/or executing the program code, includes at least one processor 502 coupled to program and data memory 504 through a system bus 550. Program and data memory 504 can include local memory employed during actual execution of the program code, bulk storage, and cache memories that provide temporary storage of at least some program code and/or data in order to reduce the number of times the code and/or data are retrieved from bulk storage during execution.

Input/output or I/O devices 506 (including but not limited to keyboards, displays, pointing devices, etc.) can be coupled either directly or through intervening I/O controllers. Network adapter interfaces 508 may also be integrated with the system to enable processing system 500 to become coupled to other data processing systems or storage devices through intervening private or public networks. Modems, cable modems, IBM Channel attachments, SCSI, Fibre Channel, and Ethernet cards are just a few of the currently available types of network or host interface adapters. Presentation device interface 510 may be integrated with the system to interface to one or more presentation devices, such as printing systems and displays for presentation of presentation data generated by processor 502.

Although specific embodiments were described herein, the scope of the invention is not limited to those specific embodiments. The scope of the invention is defined by the following claims and any equivalents thereof.

We claim:

1. A system comprising:

a printhead that includes a plurality of nozzles operable to apply only a clear fluid to a print media during a normal print mode; and a controller operable, in response to entering a diagnostic mode for quality analysis of the printhead, to:

initiate a supply of a colorant to the nozzles to form a diagnostic fluid prior to fluid ejection by the nozzles that includes a mixture of the colorant and the clear fluid; and direct the nozzles to apply the diagnostic fluid on the print media during the diagnostic mode.

2. The system of claim 1 wherein:

the colorant comprises a color that contrasts with the print media.

3. The system of claim 1 wherein:

the controller is further operable to initiate removal of the diagnostic fluid from the printhead, and to resume application of the clear fluid to the print media.

4. The system of claim 1 wherein:

the controller is operable to initiate the diagnostic mode for one or more selected printheads.

5. The system of claim 1 wherein:

the controller is operable to initiate the diagnostic mode responsive to a determination that a print job is a print chart.

6. The system of claim 1 further comprises:

a flow distributor operable to:

receive the clear fluid from a clear fluid supply tank;

receive the colorant from a colorant supply tank;

mix the clear fluid and the colorant to generate the diagnostic fluid; and supply the diagnostic fluid to the printhead.

7. The system of claim 6 wherein:

the flow distributor includes a valve positioned between the clear fluid supply tank and the colorant supply tank, wherein the valve is operable to selectively supply the colorant to the printhead during the diagnostic mode.

8. A method comprising:

entering a diagnostic mode for quality analysis of a printhead that includes a plurality of nozzles that apply only a clear fluid to a print media during a normal print mode;

responsive to entering the diagnostic mode for the printhead:

supplying a colorant to the nozzles to form a diagnostic fluid that includes a mixture of the colorant and the clear fluid; and applying the diagnostic fluid on the print media through the nozzles during the diagnostic mode.

9. The method of claim 8 wherein:

the colorant comprises a color that contrasts with the print media.

10. The method of claim 8 further comprising:

removing the diagnostic fluid from the printhead; and resuming application of the clear fluid to the print media.

11. The method of claim 8 further comprising:

initiating the diagnostic mode for one or more selected printheads.

12. The method of claim 8 further comprising:

initiating the diagnostic mode responsive to a determination that a print job is a print chart.

13. A non-transitory computer readable medium embodying programmed instructions which, when executed by a processor, are operable to perform a method comprising:

entering a diagnostic mode for quality analysis of a printhead that includes a plurality of nozzles that apply only a clear fluid to a print media during a normal print mode;

responsive to entering the diagnostic mode of the printhead:

supplying a colorant to the nozzles to form a diagnostic fluid that includes a mixture of the colorant and the clear fluid; and applying the diagnostic fluid on the print media through the nozzles during the diagnostic mode.

14. The medium of claim 13 wherein:

the colorant comprises a color that contrasts with the print media.

15. The medium of claim 13 the method further comprising:

removing the diagnostic fluid from the printhead; and resuming application of the clear fluid to the print media.

16. The medium of claim 13 wherein:

the clear fluid is an overcoat composition used for protecting ink-based images.

17. The medium of claim 13 wherein:

the clear fluid is a pre-coat composition used for preparing the print media.

18. The method of claim 8 further comprising:

initiating the diagnostic mode in response to a manual operator override.

19. The medium of claim 13 the method further comprising:

initiating the diagnostic mode in response to a manual operator override.

20. The medium of claim 13 the method further comprising:

initiating a printhead cleaning process when the diagnostic mode is exited.

* * * * *